US005801321A

United States Patent [19]

LaGrange et al.

[11] Patent Number: 5,801,321

[45] Date of Patent: Sep. 1, 1998

[54] LOW COST ENVIRONMENTALLY FRIENDLY FLARE

[75] Inventors: Donald E. LaGrange, Washington; Dennis D. Deckard, Bedford; Douglas A. Schulte, Bloomfield, all of Ind.

[73] Assignee: The United States of America as represented by the Secretary of the Navy, Washington, D.C.

[21] Appl. No.: 880,291

[22] Filed: Jun. 24, 1997

[51] Int. Cl.[6] ..... F92B 4/26

[52] U.S. Cl. ..... 102/336; 102/340; 102/355; 102/430

[58] Field of Search ..... 102/336, 340, 102/355, 430

[56] References Cited

U.S. PATENT DOCUMENTS 4,881,464 11/1989 Sayles ..... 102/336

5,561,259 10/1996 Briere et al. ..... 102/336

5,635,666 6/1997 Bannasch et al. ..... 102/336 X 5,661,257 8/1997 Nielson et al. ..... 102/336 X

OTHER PUBLICATIONS

U.S.S.I.R. #H 1603, Deckard et al., Nov. 5, 1996, 102/336.

Navsea Tech. Man. vol. 1 SW050–AB–MMA–010, 1 Jul. 1994, pp. 9–24 thru 9–26.

*Primary Examiner*—Peter A. Nelson

*Attorney, Agent, or Firm*—Kenneth W. Dobyns; William C. Townsend; Edward J. Connors, Jr.

[57] ABSTRACT

Aerial training flare or flare simulator comprising a polymeric case, a biodegradable polymeric candle housing, and a candle comprising a pyrotechnic illuminant and an environmentally friendly, fast-burning ignition composition. An expulsion cartridge ejects the candle and the candle housing while the case is retained on the launching aircraft. The only major component of the flare which falls to earth is the partially melted candle housing, which is biodegradable and thus reduces requirements for environmental cleanup.

19 Claims, 1 Drawing Sheet

LOW COST ENVIRONMENTALLY FRIENDLY FLARE

BACKGROUND OF THE INVENTION

This invention relates to flares, and more particularly to aerial training flares also known as flare simulators.

Training flares are used extensively for training pilots in the proper use of flares. Training flares are made more inexpensively, including use of a greatly reduced amount of illuminant or flare grain, and are much lower in cost than regular flares. Moreover, use of training flares does not deplete the inventory of regular flares.

Prior art training flares have suffered from disadvantages or deficiencies that prevented their being entirely satisfactory. For one thing, pyrotechnic ignition compositions used to ignite the flare grain contained lead, specifically lead oxide also known as red lead, which is environmentally undesirable. Secondly, the flares had multiple nonbiodegradable major components that were ejected from the using aircraft and fell to the surface of the earth. These components fouled training or test ranges and mandate costly environmental cleanup.

Thirdly, prior training flares required an inordinate length of time for the small quantity of flare grain to ignite, thus making it more difficult to detect whether the ejection exercise was successful.

Accordingly, main objects of the invention are to provide improvements that overcome the disadvantages and deficiencies of the prior art. Other objects of the invention will appear from the following detailed description which, together with the accompanying drawings, discloses a preferred embodiment of the invention for purposes of illustration only. For definition of the scope of the invention, reference will be made to the appended claims.

DETAILED DESCRIPTION OF THE PREFERRED EMBODIMENT

Figure 1:
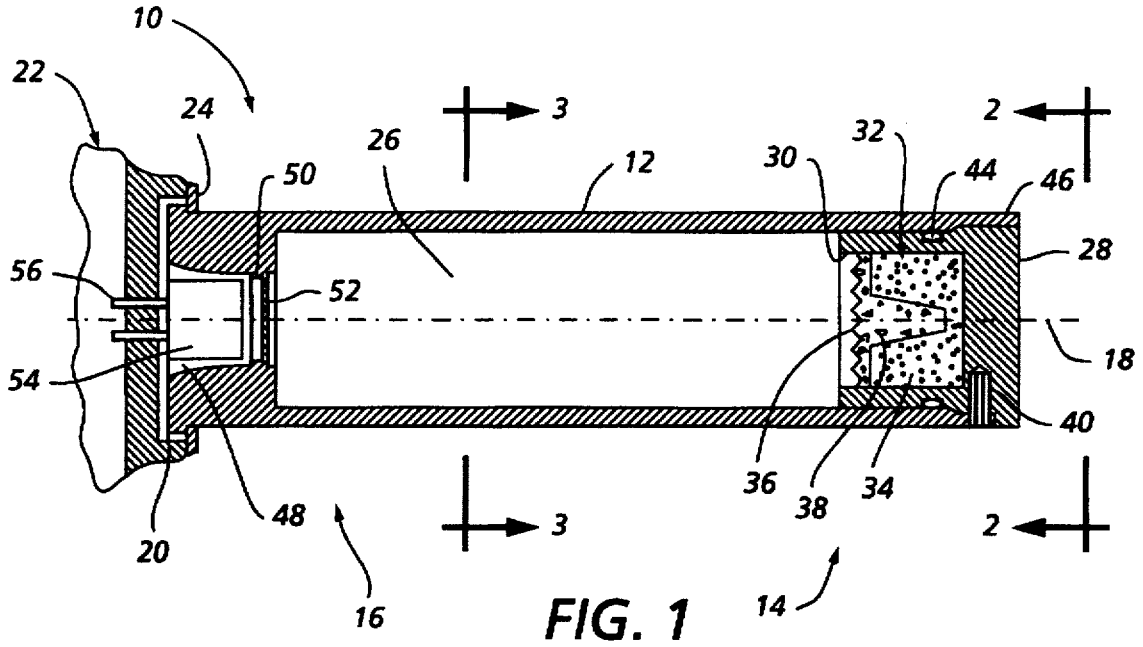
FIG. 1 is a longitudinal cross-sectional view of a flare embodying principles of the invention.
Figure 2:
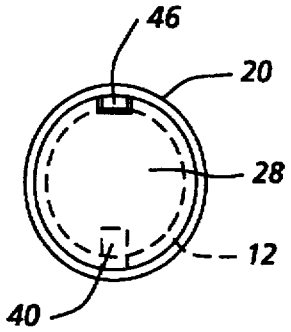
FIG. 2 is an elevational view taken on line 2—2 of FIG. 1.

The aerial training flare or flare simulator shown in FIG. 1 is generally indicated at 10 and comprises a low-cost, polymeric case 12 having fore portion 14, aft portion 16, and a fore-and-aft axis 18. Aft portion 16 has a radially outwardly projecting, annular flange 20 (see also FIG. 2) received in a counterbore in a conventional flare dispenser or launcher 22 mounted on an aircraft. Flange 20 and thus case 12 is securely held in the launcher by a clamping plate member 24 which overlies flange 20 but has an annular aperture through which case 12 protrudes.

Figure 3:
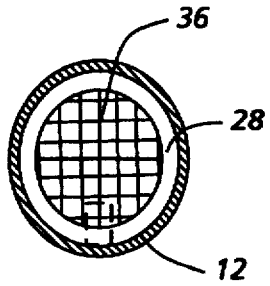
FIG. 3 is a transverse cross-sectional view taken on line 3—3 of FIG. 1.

Case 12 has interior walls defining a large first chamber 26 that extends for most of the length of the case. As will be discussed in greater detail, in a regular flare most of the volume of chamber 26 would be occupied by the pyrotechnic flare grain, also termed illuminant. In the flare according to the invention, there is a biodegradable, polymeric candle housing 28 disposed in chamber 26 at the fore portion of case 12. Candle housing 28 defines a closure for chamber 26, and has a cavity 30 opening toward the aft portion of the case. A pyrotechnic candle 32 is disposed in cavity 30 and comprises a mass 34 of pyrotechnic illuminant or flare grain, and a mass 36 of environmentally friendly, fast-burning ignition composition interposed between illuminant 34 and the aft portion of the case. The ignition composition has a waffle surface (see also FIG. 3) facing aftwardly, and a frustoconical, forwardly projecting portion 38 embedded in the mass of illuminant 34. The waffled surface of the ignition composition facilitates its ignition by means to be described by exposing a greater surface area to the igniting means. Projection 38 in turn facilitates ignition of the pyrotechnic illuminant by the ignition composition by increasing the surface area of illuminant exposed to the ignition composition.

As previously indicated, in regular flares most of the volume of large chamber 26 is filled with flare grain or illuminant, which is costly. In training flares according to the invention, most of this volume is empty and the mass of pyrotechnic illuminant preferably extends only up to about 15% of the length of the case. Thus, substantial savings in illuminant costs are realized over training with regular flares.

Figure 4:
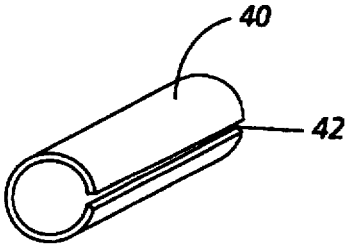
FIG. 4 is a detail view of a spring pin used in the embodiment of FIG. 1.

Candle housing 28 is releasably secured in case 12 by a spring steel pin 40 (see also FIG. 4) which is received in aligned apertures in case 12 and candle housing 28. Spring pin 40 is a hollow cylindrical sheet metal member having a slit 42 along the length of the cylinder. The aligned apertures in the case and candle housing that receive the pin have a diameter slightly less than that of the uncompressed cylinder of the pin so that the pin must be compressed by narrowing the width of slit 42 to insert the pin into the case and candle housing. When inserted, the stored energy of compression in the spring pin bears tightly against the walls of the apertures in the case and candle housing to securely hold the candle housing in the case. Spring pin 40 is contiguous to the fore end portion of case 12 and as will be seen, the portion of the case between the pin and the end of the case is broken away on activation of the flare to release the candle housing from the case.

A conventional rubber O-ring 44 is fitted in an annular groove in candle housing 28 and circumscribes the candle housing to form a weather tight seal between the candle housing and the case. Case 12 has a forwardly projecting tab portion 46 (FIGS. 1, 2) that fits into a mating notch in candle housing 28 to facilitate assembly of the candle housing in the case in proper orientation for insertion of spring pin 40.

A second chamber 48 is formed in case 12 at the aft portion thereof. Chamber 48 opens in a direction aft of the case. A passageway 50 formed in the case communicates between first chamber 26 and second chamber 48, and is closed by a breakaway disk 62. Chamber 48 is configured to receive an expulsion charge 54 that is affixed to launcher 22 and has a pair of electrical pins 56 plugged into circuitry (not shown) in the launcher to receive an electrical signal from the pilot to activate the expulsion charge. Expulsion charge 54 may be of any suitable type, including conventional CCU-63/B or CCU-136/B impulse cartridges.

In operation, activation of the expulsion charge, which is explosive, ruptures breakaway disk 52 and the hot gases and particles from the expulsion charge ignite mass 36 of ignition composition. The shock wave front from the exploding expulsion charge impacts with force on the candle and candle housing, which causes pin 40 to apply stress to the portion of the polymeric case between the pin and the fore end of the case, which shatters that portion of the case so that the pin moves with the candle housing out of the case as the candle and candle housing are ejected from the case which remains affixed to launcher 22. The ignition composition ignites the mass of pyrotechnic illuminant in the candle housing and the flare separates from the aircraft and burns and falls. The only major component of the flare that normally comes to rest on the surface of the earth is the partially melted candle housing, which is biodegradable.

It is preferred that the polymeric candle housing be a polyhydroxybutyrate covalerate thermoplastic polyester such as is sold under the trade name Biopol D311G by the Monsanto Technical Center, Parc Scientifique, Rue Laid Burniat, B-1348 Louvain-la-Neuve, Belgium.

It is further preferred that the ignition composition be a lead-free, pressed particulate material consisting essentially of magnesium powder, polytetrafluoroethylene, and a copolymer consisting essentially of vinylidene fluoride and hexafluoropropylene. It is most preferred that the ignition composition consist essentially of about 73 weight percent magnesium powder, about 22 weight percent polytetrafluoroethylene, and about 5 weight percent copolymer consisting essentially of about 79 mole percent vinylidene fluoride and about 21 mole percent hexafluoropropylene. About 2–3 grams of the ignition composition may be used.

Polymeric case 12 is preferably made of glass-reinforced polyphenylene oxide such as is sold under the trade name Noryl 731 by the General Electric Company, Plastic Business Group, Noryl Avenue, Selkirk, N.Y. This material contains about 20% reinforcing fiberglass.

Various illuminant compositions may be employed, and the flexibility to use different illuminants is an advantage of the invention. About 8–9 grams of pressed particulate illuminant may be used. One suitable composition consists essentially of about 54 weight percent magnesium powder, about 30 weight percent polytetrafluoroethylene (PTFE) molding material conforming to ASTM D4894, and about 16 weight percent of the vinylidene fluoride copolymer described above in connection with the ignition composition. Another suitable illuminant composition consists essentially of about 52 weight percent magnesium powder, about 30 weight percent of the above-described PTFE, and about 18 weight percent of the above-described copolymer. Still another illuminant composition consists essentially of about 58 weight percent magnesium powder, about 36 weight percent sodium nitrate, and about 6 weight percent binder consisting essentially of about 70 weight percent epoxy resin and about 30 weight percent polyamide curing agent.

Flares made in accordance with the invention are highly advantageous. Use of red lead ignition composition, which is harmful to the environment, is eliminated. Only one major component (the candle housing) normally falls to earth and it is biodegradable, thus reducing requirements for environmental cleanup. The flare lights as it exits the aircraft instead of 50–100 feet away as with the prior art. Put another way, time to light is reduced to virtually zero. And all the foregoing is accomplished with a reduction in cost of about one-third. Use of a minimum number of components, and low-cost plastic materials, contributes heavily to the cost savings.

We claim:

1. A flare, comprising a polymeric case having fore and aft portions, the aft portion of the case being configured for affixation to a launcher, means defining a first chamber in the case, a biodegradable polymeric candle housing disposed in the first chamber at the fore portion of the case, the candle housing having a cavity opening toward the aft portion of the case, a pyrotechnic candle disposed in the cavity and comprising a mass of pyrotechnic illuminant, and a mass of environmentally friendly, fast-burning ignition composition interposed between the illuminant and the aft portion of the case, releasable securing means for securing the candle housing in the case, means defining a second chamber in the aft portion of the case, the second chamber opening in a direction aft of the case, and means defining a passageway communicating between the first and second chambers, the second chamber being configured to receive expulsion charge means affixed to the launcher for igniting the ignition composition, releasing the securing means, and ejecting the candle and the candle housing from the case.

2. The flare of claim 1, in which the biodegradable polymeric candle housing is a polyhydroxybutyrate covalerate thermoplastic polyester.

3. The flare of claim 1, in which the ignition composition is lead-free pressed particulate material consisting essentially of magnesium powder, polytetrafluoroethylene, and a copolymer consisting essentially of vinylidene fluoride and hexafluoropropylene.

4. The flare of claim 3, in which the ignition composition consists essentially of about 73 weight percent magnesium powder, about 22 weight percent polytetrafluoroethylene, and about 5 weight percent copolymer consisting essentially of about 79 mole percent vinylidene fluoride and about 21 mole percent hexafluoropropylene.

5. The flare of claim 1, in which the polymeric case consists essentially of fiberglass-reinforced polyphenylene oxide.

6. The flare of claim 1, in which the mass of ignition composition has a forwardly projecting portion embedded in the mass of illuminant.

7. An aerial training flare, comprising a polymeric case having fore and aft portions, the aft portion of the case being configured for affixation to a launcher on an aerial vehicle, means defining a first chamber in the case, a biodegradable polymeric candle housing disposed in the first chamber at the fore portion of the case, the candle housing having a cavity opening toward the aft portion of the case, a pyrotechnic candle disposed in the cavity and comprising a mass of pyrotechnic illuminant, and a mass of environmentally friendly, fast-burning ignition composition interposed between the illuminant and the aft portion of the case, releasable securing means for securing the candle housing in the case, means defining a second chamber in the aft portion of the case, the second chamber opening in a direction aft of the case, and means defining a passageway communicating between the first and second chambers, the second chamber being configured to receive expulsion charge means affixed to the launcher for igniting the ignition composition, releasing the securing means, and ejecting the candle and the candle housing from the case.

8. The flare of claim 7, in which the case has a fore-and-aft axis and a length extending along the axis, and the mass of pyrotechnic illuminant extends up to about 15% of the length of the case.

9. The flare of claim 7, in which the biodegradable polymeric candle housing is a polyhydroxybutyrate covalerate thermoplastic polyester.

10. The flare of claim 7, in which the ignition composition is lead-free pressed particulate material consisting essentially of magnesium powder, polytetrafluoroethylene, and a copolymer consisting essentially of vinylidene fluoride and hexafluoropropylene.

11. The flare of claim 10, in which the ignition composition consists essentially of about 73 weight percent magnesium powder, about 22 weight percent polytetrafluoroethylene, and about 5 weight percent copolymer consisting essentially of about 79 mole percent vinylidene fluoride and about 21 mole percent hexafluoropropylene.

12. The flare of claim 7, in which the polymeric case consists essentially of fiberglass-reinforced polyphenylene oxide.

13. The flare of claim 7, in which the mass of ignition composition has a forwardly projecting portion embedded in the mass of illuminant.

14. An aerial training flare, comprising a polymeric case having fore and aft portions, the aft portion of the case being configured for affixation to a launcher on an aerial vehicle, means defining a first chamber in the case, a biodegradable polymeric candle housing disposed in the first chamber at the fore portion of the case, the candle housing defining a closure for the first chamber, the candle housing having a cavity opening toward the aft portion of the case, a pyrotechnic candle disposed in the cavity and comprising a mass of pyrotechnic illuminant, and a mass of environmentally friendly, fast-burning ignition composition interposed between the illuminant and the aft portion of the case, the mass of ignition composition having a forwardly projecting portion embedded in the mass of illuminant, releasable securing means for securing the candle housing in the case, sealing means circumscribing the candle housing for forming a weather tight seal between the candle housing and the case, means defining a second chamber in the aft portion of the case, the second chamber opening in a direction aft of the case, means defining a passageway communicating between the first and second chambers, and breakaway means for closing the passageway, the second chamber being configured to receive expulsion charge means affixed to the launcher for rupturing the breakaway means, igniting the ignition composition, releasing the securing means, and ejecting the candle and the candle housing from the case.

15. The flare of claim 14, in which the case has a fore-and-aft axis and a length extending along the axis, and the mass of pyrotechnic illuminant extends up to about 15% of the length of the case.

16. The flare of claim 15, in which the biodegradable polymeric candle housing is a polyhydroxybutyrate covalerate thermoplastic polyester.

17. The flare of claim 16, in which the ignition composition is lead-free pressed particulate material consisting essentially of magnesium powder, polytetrafluoroethylene, and a copolymer consisting essentially of vinylidene fluoride and hexafluoroethylene.

18. The flare of claim 17, in which the ignition composition consists essentially of about 73 weight percent magnesium powder, about 22 weight percent polytetrafluoroethylene, and about 5 weight percent copolymer consisting essentially of about 79 mole percent vinylidene fluoride and about 21 mole percent hexafluoropropylene.

19. The flare of claim 18, in which the polymeric case consists essentially of fiberglass-reinforced polyphenylene oxide.

* * * * *